US005915460A

United States Patent [19]

Courson et al.

[11] Patent Number: 5,915,460

[45] Date of Patent: Jun. 29, 1999

[54] GUIDE SEGMENT SUPPORT SYSTEM FOR CONTINUOUS CASTING

[75] Inventors: Harry J. Courson, Butler; James B. Sears, Cranberry Township, both of Pa.

[73] Assignee: AG Industries, Inc., Coraopolis, Pa.

[21] Appl. No.: 08/960,729

[22] Filed: Oct. 30, 1997

Related U.S. Application Data

[63] Continuation of application No. 08/691,010, Aug. 5, 1996, abandoned.

[51] Int. Cl.[6] ..... B22D 11/128

[52] U.S. Cl. ..... 164/484; 164/442

[58] Field of Search ..... 164/441, 442, 164/447, 448, 484

[56] References Cited

U.S. PATENT DOCUMENTS 3,627,026 12/1971 Bohne ..... 164/448

FOREIGN PATENT DOCUMENTS 597944 4/1978 Switzerland ..... 164/448

628990 10/1978 U.S.S.R. ..... 164/448

*Primary Examiner*—Kuang Y. Lin

*Attorney, Agent, or Firm*—Knoble & Yoshida LLC

[57] ABSTRACT

An improved guide segment assembly for a continuous casting machine includes a support frame and a guide segment that includes a bottom segment portion having a number of support rolls for engaging a bottom surface of a continuously cast strand, and a top segment having a number of guide rolls thereon for engaging a top surface of the strand. A force applicator is provided for urging the top and bottom segment portions toward one another against mechanical stops in order to provide support for the strand that is sufficient to counter ferrostatic pressure within the strand. A resilient mechanism is positioned between the support frame and the guide segment for permitting limited movement between the support frame and the guide segment during abnormal casting conditions. As a result of the resilient mechanism, both the support rolls and the guide rolls will be amply protected against overload conditions during abnormal conditions such as cold withdrawals.

15 Claims, 3 Drawing Sheets

GUIDE SEGMENT SUPPORT SYSTEM FOR CONTINUOUS CASTING

This is a continuation of application Ser. No. 08/691,010, filed Aug. 5, 1996, now abandoned.

BACKGROUND OF THE INVENTION

1. Field of the Invention

This invention relates to the continuous casting industry. More specifically, this invention relates to an improved guide segment support system and method for supporting and guiding a cast strand after it emerges from a mold.

2. Description of the Related Technology

Metals such as steel are continuously cast into strands by pouring hot, molten metal into the upper end of a mold and continuously withdrawing a metal strand from the mold's bottom. As the molten metal passes through the mold, the surfaces of the metal that are adjacent to the mold walls are cooled, solidified and hardened to form a casing or shell of solidified metal around the molten metal in the strand. After leaving the bottom of the mold, the metal continues to cool and the casing or shell of solidified metal around the molten core thickens until the whole strand section is solidified.

The shell of solidified metal around the molten core, as the continuous cast strand leaves the mold, is relatively thin and fragile, and requires support. Such support, in continuous casting of metals, is customarily provided by rolls which engage and support the opposite sides of the continuously cast strand. The supporting rolls immediately below the mold, where the shell of solidified metal is relatively thin, are usually of relatively small diameter and are longitudinally spaced closely together. To assist cooling of the slab and to prevent the rolls and bearings from overheating, these supporting rolls may be liquid cooled. Further away from the mold bottom, where the metal has cooled and the shell of solid metal has thickened, rolls of larger diameter, spaced at greater longitudinal distance, are usually employed. To control the casting speed, certain of the supporting and guiding rolls may be driven. Typically, of course, the supporting rolls are arranged about an arcuate path or apron that defines the path of the strand as it emerges vertically downwardly from the mold, then gradually bends about a 90 degree arc until it emerges as a fully solidified, horizontally oriented casting. Space is generally provided between the rolls for permitting introduction of spray water to cool the cast strand.

Conventionally, the opposed supporting and guiding rolls are divided into segments. On the outside radius of the arcuate path that is defined by the guide rollers, a supporting frame (commonly referred to as a "banana beam") is provided to which these segments are attached. In order to permit repair and maintenance work to be effected on the segments, the segments are designed to be exchangeable. The segments of the apron can be exchanged with the help of a segment changing carriage which runs on rails extending parallel to the apron, or, in some machines, can be lifted out by a building-mounted crane system. The segments can be transferred to this carriage and carried thereon to a point where they can be removed from the plant and repaired or readjusted as may be required.

Each segment includes a "bottom" portion containing a bottom set of rolls that engages the side of the strand that is closest to the supporting frame or banana beam, which is the side that defines the outer radius of the arc through which the strand is guided to move. The bottom portion of the segment is always, in the experience of the inventor, securely mounted to the supporting frame so that no relative movement is permitted between the bottom portion and the supporting frame. Each segment will also include a "top" portion that holds a top set of rolls for supporting the inner radius side of the strand. To provide the necessary support to the strand, and to counter ferrostatic pressure that develops in the strand during its vertical descent, the top portion and the bottom portion are urged together by a controlled force, which is typically exerted by a hydraulic mechanism that is mounted on the segment. The top and bottom portion alternatively are connected by a spring structure jacking mechanism that permits limited movement therebetween during operation.

During normal casting operation, the top and bottom portions of the strand are urged together at a relatively constant force against mechanical stops so that the distance between the opposing top and bottom rolls is maintained constant. Unfortunately, the magnitude of this force can be so great that damage to the rolls, roll bearings, roll supports and segments can and often do occur, particularly during abnormal casting conditions. For example, if the casting machine is caused to stop for any length of time, it might be necessary to withdraw the solidified strand from the apron of support rollers by performing what is referred to in the industry as a "cold strand withdrawal." In this procedure, the fully solidified strand is caused to be bent into its desired final horizontal shape as it travels through the arc-shaped array of guide and support rolls by the pressure that is exerted on the strand by the rolls. In current systems, this often initiates failure of one or more guide rolls (usually, in the inventor's experience, by yielding or fracturing the bearing races), although it might take several weeks to find out which rolls are going to fail. Bearing failure, in the inventor's experience, most often occurs in the bottom portion of the segment, which is rigidly mounted to the banana beam. Of course, when failure does occur, it adversely affects the quality of the cast product, which is a major economic concern for the steel maker. Other conditions that can cause failure of the rolls include bulges or irregularities in the strand being cast. If the irregularity is on the top side of the strand, forces may be partially absorbed by the spring structure or by the opening of the hydraulic clamping cylinders by action of associated pressure relief valves. If the irregularity is on the bottom, though, the spring structure does not provide much protection against a force overload condition being applied against the lower rolls.

A need exists for an improved strand support segment system that is designed so as to minimize the potential for early failure as a result of abnormal conditions such as cold strand withdrawal or the presence of irregularities in the strand being cast.

SUMMARY OF THE INVENTION

Accordingly, it is an object of the invention to provide an improved guide segment support system for a continuous casting system that is designed so as to minimize the potential for early failure as a result of abnormal conditions such as cold strand withdrawal or the presence of irregularities in the strand being cast.

In order to achieve the above and other objects of the invention, an improved guide segment assembly for a continuous casting machine includes a support frame; a guide segment that includes a bottom segment portion having a number of support rolls thereon for engaging a bottom surface of a strand that has been cast in a continuous casting machine; a top segment portion having a number of guide rolls thereon for engaging a top surface of such a strand; force application structure for urging the top and bottom segment portions toward one another in order to provide support for the strand that is sufficient to counter ferrostatic pressure within the strand; and resilient structure, positioned between the support frame and the guide segment, for permitting limited movement between the support frame and the guide segment during an abnormal casting condition, whereby both the support rolls and the guide rolls will be amply protected against overload conditions during abnormal casting conditions.

According to a second aspect of the invention, a method of guiding a strand of continuously cast material in a guide segment of the type that includes a bottom segment portion having a number of support rolls thereon for engaging a bottom surface of a strand, and a top segment portion having a number of guide rolls thereon for engaging a top surface of such a strand, the guide segment being mounted to a support member, includes steps of (a) urging the top and bottom segment portions together to support the strand between the support rolls and the guide rolls in an amount of force that is sufficient to counteract ferrostatic pressure that exists within the strand; and (b) in response to an abnormal casting condition that exerts force on the top or bottom segment portions that exceeds a predetermined maximum, resiliently adjusting the spacing between the guide segment and the support member, wherein force against either the support rolls or the guide rolls is relieved before it reaches failure-causing levels, whereby the guide segment is protected against damage in the event of abnormal casting conditions.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
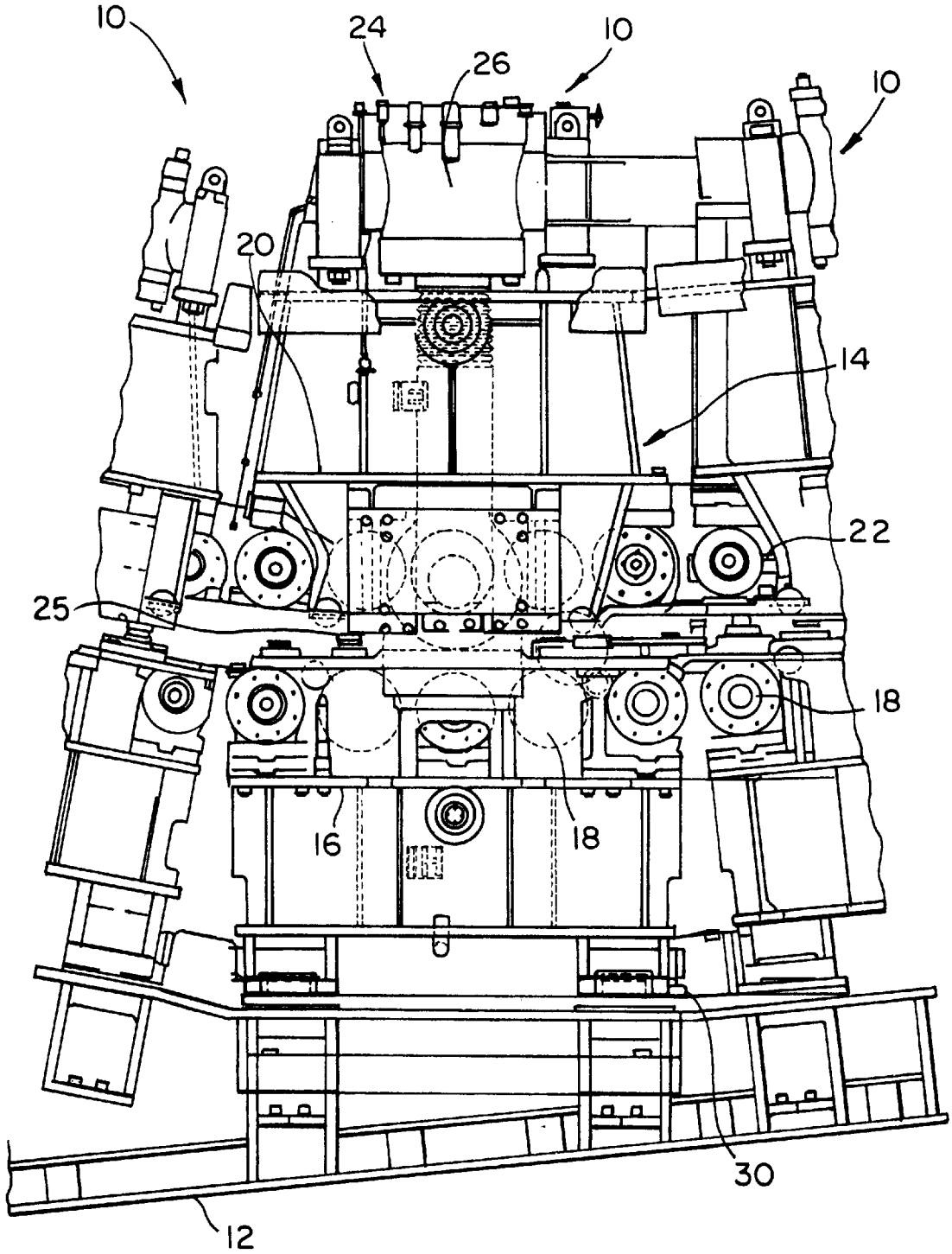
FIG. 1 is a fragmentary side view of an improved guide segment assembly for a continuous casting machine that is constructed according to a preferred embodiment of the invention.

Referring now to the drawings, wherein like reference numerals designate corresponding structure throughout the views, and referring in particular to FIG. 1, an improved guide segment apron assembly 10 for a continuous casting machine includes a support frame 12, which in the preferred embodiment (and as is generally known) follows a generally arcuate path along an outer radius of the path along which the strand of continuously cast material is guided by the guide segment apron assembly 10. Support frame 12 is also commonly referred to as a "banana beam." As may be seen in FIG. 1, the guide segment apron assembly 10 consists of a number of guide segments 14, each of which includes a bottom segment portion 16 having a number of support rolls 18 thereon for engaging a bottom surface of a strand that has been cast in a continuous casting machine. Each guide segment 14 further includes a top segment portion 20 that has a number of guide rolls 22 thereon for engaging a top surface of the strand. As is generally known in this area of technology, a force application system 24 is provided for urging the top and bottom segment portions 20, 16 toward another against mechanical stops 25 in order to provide support for the strand that is sufficient to counter ferrostatic pressure within the strand. In the illustrated embodiment, force application system 24 is embodied as a hydraulic cylinder 26. Alternatively, as is known in the art, other force application mechanisms can be used, such as a number of jack screws in conjunction with a spring mechanism.

Figure 2:
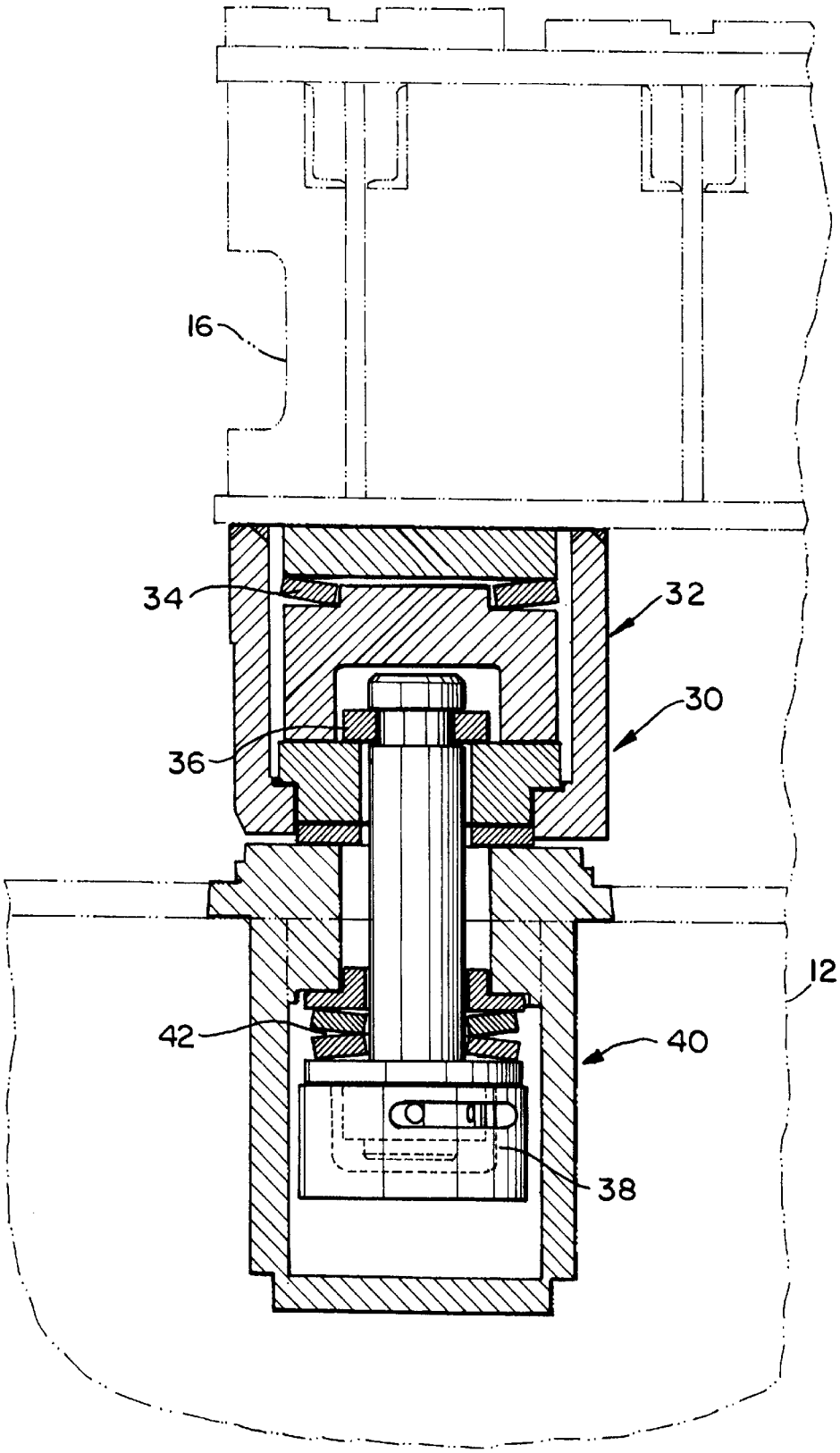
FIG. 2 is a cross sectional view taken through one component of the system that is shown in FIG. 1.

As may be seen in FIG. 1, the bottom segment portion 16 is supported with respect to the support frame 12 by a number of support feet 30, which are shown in cross section in greater detail in FIG. 2. Looking now to FIG. 2, it will be seen that each foot 30 incorporates a resilient mechanism 32, positioned between the support frame 12 and the guide segment 14, for permitting limited movement between the support frame 12 and the guide segment 14 during an abnormal casting condition. Examples of abnormal casting conditions that might cause such limited movement include a cold strand withdrawal procedure or the presence of irregularities in one or both of the sides of the casting.

More specifically, as may be seen in FIG. 2, resilient mechanism 32 is connected between the support frame 12 and the bottom segment portion 16 of the guide segment 14, and is designed to permit limited movement between the support frame 12 and the bottom segment portion 16. In the embodiment that is illustrated in FIG. 2, the resilient mechanism 32 is embodied as one or more preloaded disc springs 34 that is interposed between the support frame 12 and the bottom segment portion 16 of the guide segment 14. Also shown in FIG. 2 is a preloaded hold-down mechanism 40 for resiliently holding the bottom segment portion 16 of the guide segment 14 to the support frame 12. Hold-down mechanism 40 includes a disc spring assembly 42 that is arranged to provide a downward force to a yoke 36 that is connected to the bottom segment portion 16, through the support foot 30 and resilient mechanism 32, as may be seen in FIG. 2. A hydraulic nut 38 is provided to pretension the disc spring assembly 42. Alternatively, pretensioning could be effected by an external hydraulic jack or equivalent mechanism.

Preferably, the resilient mechanism 32 is configured to permit an amount of deflection between the support frame 12 and the bottom segment portion 16 during operation that is within the range of about 1/16th of an inch to about 1 inch. More preferably, the resilient mechanism 32 is configured to permit an amount of deflection between the support frame 12 and the bottom segment portion 16 that is within the range of about 1/8th of an inch to about 1/2 of an inch. In the embodiment of FIG. 2, the amount of permitted deflection corresponds to the amount of linear collapse that is provided by the preloaded disc springs 34.

Figure 3:
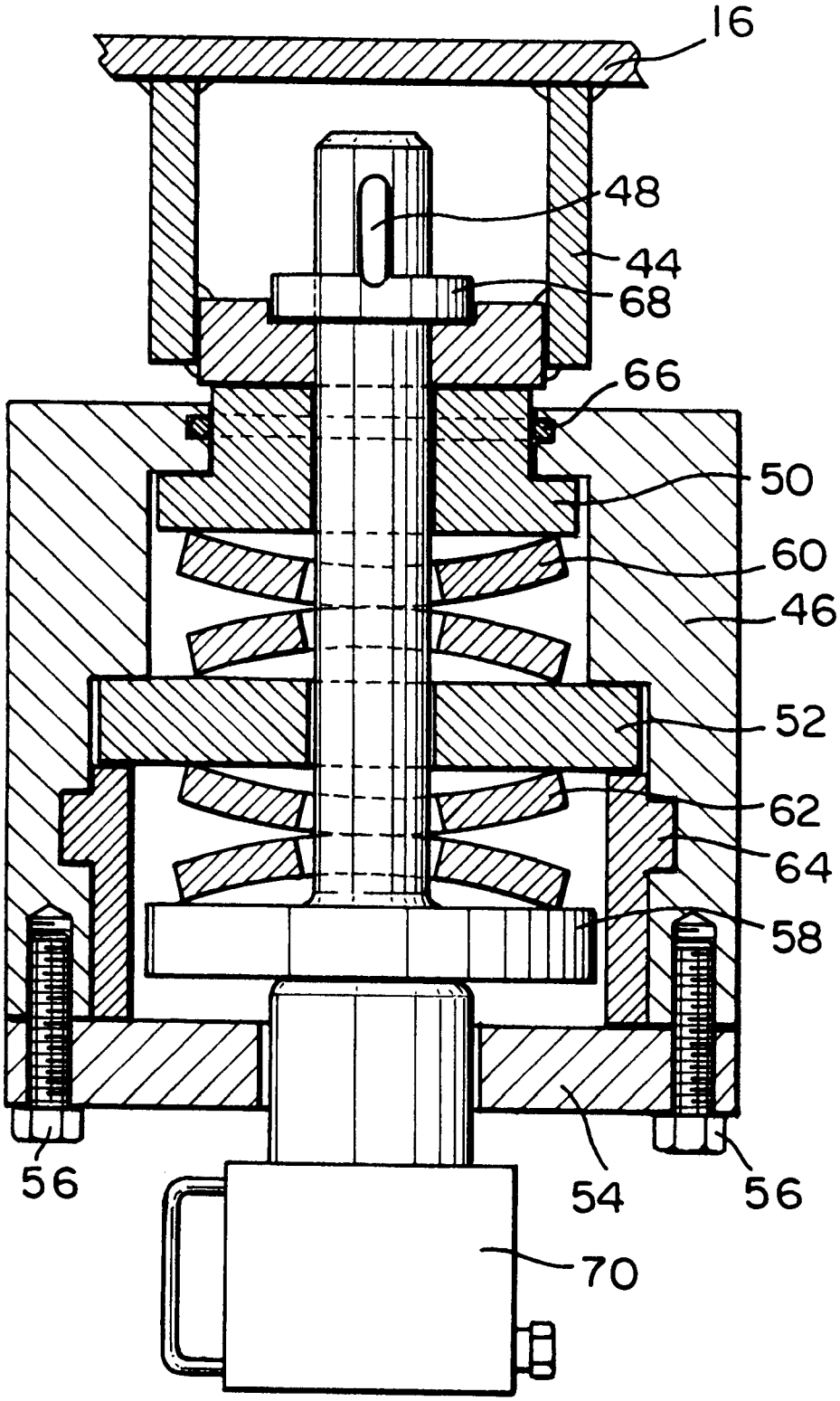
FIG. 3 is a diagrammatical view of an alternative embodiment to the component that is depicted in FIG. 2.

FIG. 3 depicts a resilient mechanism for providing limited movement between the support frame 12 and the bottom segment portion 16 that is constructed according to a second preferred embodiment of the invention. In this embodiment, a support foot 44 is mounted to the bottom segment portion 16, and a housing 46 is mounted to the support frame 12. A pin member 58 is positioned for movement within the housing 46. A stationary plate 52 is positioned statically within the housing 46 and is held in place with a pair of support bars 64. A bottom retainer plate 54, which is provided to retain the pin member 58 within the housing 46, is affixed to the housing 46 by a plurality of retainer bolts 56.

A tensioning disc spring 62 is provided within the housing 46 so as to be interposed between a head plate portion of pin member 58 and stationary plate 52. A cushioning disc spring 60 is interposed within the housing 46 between the stationary plate 52 and a plunger 50 that is axially movable within the housing 46 and is sealed with respect thereto by a seal 66. As is shown in FIG. 3, pin member 58 extends through axial holes that are defined in plate 52, springs 60, 62, plunger 50 and support foot 44, and has a radial slot defined in a distal end that is positioned beyond support foot 44. A retaining bar 48 is positioned in the radial slot for keeping the pin member 58 retained in the support foot 44. A replaceable contact ring 68 is positioned within the support foot 44 for absorbing contact with the retaining bar 48. A hydraulic jack 70 may be positioned as shown in FIG. 3 for removing the retaining bar 48 during disassembly, such as for maintenance.

During operation, downward forces that are applied to the bottom segment portion 16 will be absorbed by the cushioning disc spring 60. The tensioning disc spring 62 acts to keep pin member 58 pretensioned during operation, thereby preventing separation of the bottom segment portion 16 from the support frame apron 12.

In operation a strand of continuously cast material will be passed between the support rolls 18 on the bottom segment portion 16 and the guide rolls 22 on the top segment portion 20. As this occurs, the force application system 24 forces the top and bottom segment portions 16, 20 toward one another, thus providing support pressure against the strand that counters the ferrostatic pressure within the strand.

In the event of an abnormal casting condition, such as the presence of a bulge or irregularity on the surface of the strand, or in the event of a cold withdrawal procedure, greater forces are applied to the support rolls 18 and the guide rolls 22. When such forces exceed a predetermined maximum, the resilient mechanism will be caused to deflect, thus relieving the pressure and reducing the likelihood of failure of one or more of the support rolls 18 or guide rolls 22.

It is to be understood, however, that even though numerous characteristics and advantages of the present invention have been set forth in the foregoing description, together with details of the structure and f unction of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved guide segment assembly for a continuous casting machine, comprising:

a support frame;

a guide segment supported by said support frame, comprising:

a bottom segment portion having a number of support rolls thereon for engaging a bottom surface of a strand that has been cast in a continuous casting machine;

a top segment portion having a number of guide rolls thereon for engaging a top surface of such a strand; and force application means for urging said top and bottom segment portions toward one another in order to provide support for the strand that is sufficient to counter ferrostatic pressure within the strand; and resilient means, operatively positioned between said support frame and said guide segment, for permitting limited movement between the support frame and the guide segment during an abnormal casting condition, whereby both the support rolls and the guide rolls will be amply protected against overload conditions during abnormal casting conditions.

2. An assembly according to claim 1, wherein said resilient means is positioned between said support frame and said bottom segment portion for permitting limited movement between the support frame and the bottom segment portion.

3. An assembly according to claim 1, wherein said resilient means is configured to permit an amount of deflection between the support frame and the guide segment during operation that is within the range of about 1/16th of an inch to about 1 inch.

4. An assembly according to claim 3, wherein said resilient means is configured to permit an amount of deflection between the support frame and the guide segment during operation that is within the range of about 1/8th of an inch to about ½ of an inch.

5. An assembly according to claim 2, wherein said resilient means is configured to permit an amount of deflection between the support frame and the bottom segment portion during operation that is within the range of about 1/16th of an inch to about 1 inch.

6. An assembly according to claim 5, wherein said resilient means is configured to permit an amount of deflection between the support frame and the bottom segment portion during operation that is within the range of about 1/8th of an inch to about ½ of an inch.

7. An assembly according to claim 1, wherein said force application means comprises a hydraulic cylinder.

8. An assembly according to claim 1, wherein said resilient means comprises a plurality of spring members that are interposed between said support frame and said guide segment.

9. An assembly according to claim 1, wherein said resilient means comprises a plurality of spring members that are interposed between said support frame and said bottom segment portion.

10. A method of guiding a strand of continuously cast material in a continuous casting machine of the type that includes a support frame and a guide segment supported by said support frame of the type that includes a bottom segment portion having a number of support rolls thereon for engaging a bottom surface of a strand, and a top segment portion having a number of guide rolls thereon for engaging a top surface of such a strand, the guide segment being mounted to a support member, comprising:

(a) urging the top and bottom segment portions together to support the strand between the support rolls and the guide rolls in an amount of force that is sufficient to counteract ferrostatic pressure that exists within the strand; and (b) in response to an abnormal casting condition that exerts force on said top or bottom segment portions that exceeds a predetermined maximum, resiliently adjusting the spacing between the guide segment and the support member by means of a resilient mechanism that is operatively positioned between the support frame and the guide segment, wherein force against either said support rolls or said guide rolls is relieved before it reaches failure-causing levels, whereby the guide segment is protected against damage in the event of abnormal casting conditions.

11. A method according to claim 10, wherein step (b) is performed by permitting limited movement between the support frame and the bottom segment portion.

12. A method according to claim 11, wherein step (b) is performed to permit an amount of deflection between the support frame and the guide segment during operation that is within the range of about 1/16th of an inch to about 1 inch.

13. A method according to claim 12, wherein step (b) is performed to permit an amount of deflection between the support frame and the guide segment during operation that is within the range of about 1/8th of an inch to about 1/2 of an inch.

14. A method according to claim 10, wherein step (b) is performed to permit an amount of deflection between the support frame and the bottom segment portion during operation that is within the range of about 1/16th of an inch to about 1 inch.

15. A method according to claim 14, wherein step (b) is performed to permit an amount of deflection between the support frame and the bottom segment portion during operation that is within the range of about 1/8th of an inch to about 1/2 of an inch.

* * * * *